US008870610B2

(12) United States Patent
Tsuji

(10) Patent No.: US 8,870,610 B2
(45) Date of Patent: Oct. 28, 2014

(54) TERMINAL FITTING WITH WELDED PORTION

(75) Inventor: Takeshi Tsuji, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 78 days.

(21) Appl. No.: 13/420,726

(22) Filed: Mar. 15, 2012

(65) Prior Publication Data

US 2012/0244759 A1 Sep. 27, 2012

(30) Foreign Application Priority Data

Mar. 24, 2011 (JP) ..... 2011-066725

(51) Int. Cl.
*H01R 4/02* (2006.01)
*H01R 4/18* (2006.01)
*H01R 11/12* (2006.01)

(52) U.S. Cl.
CPC ..... *H01R 4/029* (2013.01); *H01R 4/185* (2013.01); *H01R 11/12* (2013.01)
USPC ..... 439/874; 439/883

(58) Field of Classification Search
CPC ..... H01R 11/12
USPC ..... 439/874, 880, 883; 29/860
See application file for complete search history.

(56) References Cited

U.S. PATENT DOCUMENTS 2,350,765 A * 6/1944 Johnson ..... 439/879
2,503,559 A * 4/1950 Miloche ..... 439/858
2,668,279 A * 2/1954 Epstein ..... 439/865
4,940,425 A * 7/1990 Hass et al. ..... 439/397
5,025,554 A * 6/1991 Dohi ..... 29/860
6,280,263 B1 * 8/2001 Manor et al. ..... 439/801
6,334,798 B1 * 1/2002 Ushijima et al. ..... 439/879
6,361,384 B1 * 3/2002 Manor et al. ..... 439/883
6,447,324 B1 * 9/2002 Nimura et al. ..... 439/397
6,969,276 B2 * 11/2005 Ono et al. ..... 439/518
7,008,274 B2 * 3/2006 Hayashi et al. ..... 439/877
7,033,233 B2 * 4/2006 Fujimoto et al. ..... 439/874
7,077,712 B2 * 7/2006 Sakaguchi et al. ..... 439/877
7,347,738 B2 * 3/2008 Hsieh et al. ..... 439/687
7,347,747 B2 * 3/2008 Shimizu ..... 439/852
7,581,966 B2 * 9/2009 Shigehisa et al. ..... 439/98
7,695,330 B2 * 4/2010 Noda et al. ..... 439/877
7,705,265 B2 * 4/2010 Asakura et al. ..... 219/121.64
7,901,246 B2 * 3/2011 Takayama ..... 439/585
8,137,116 B2 * 3/2012 Omori et al. ..... 439/92
2002/0028612 A1 * 3/2002 Ushijima et al. ..... 439/879
2007/0264865 A1 * 11/2007 Hagikura et al. ..... 439/493
2008/0244889 A1 10/2008 Hagikura et al.

* cited by examiner

*Primary Examiner* — Neil Abrams
(74) *Attorney, Agent, or Firm* — Gerald E. Hespos; Michael J. Porco; Matthew T. Hespos

(57) ABSTRACT

A terminal fitting (10) includes a terminal main body (21) with a bottom wall (22) on which cores (71) of wires (70) are placed, and two side walls (23) that stand up from opposite lateral sides of the bottom wall (22). A welding portion (25) where the cores (71) are welded to the bottom wall (22) is formed at a front part of the terminal main body (21). A crimping portion (26) is formed at a rear part of the terminal main body (21) and has crimping pieces (27) projecting from upper ends of the side walls (23) for crimped connection to the wires (70). Cutouts (28AF, 28AR) are cut into the upper end of the side wall (23) of the crimping portion (26) at front and rear sides of the front crimping piece (27F) while retaining parts of the side wall (23L) below the cutouts (28AF, 28AR).

8 Claims, 9 Drawing Sheets

TERMINAL FITTING WITH WELDED PORTION

BACKGROUND OF THE INVENTION

1. Field of the Invention

The invention relates to a terminal fitting.

2. Description of the Related Art

U.S. Patent Application Publication No. 2008/244889 discloses a terminal fitting with a main body that has an angular U-shaped cross section. The main body includes a bottom wall on which wires are to be placed and two side walls that stand up from opposite lateral sides of the bottom wall. Upper ends of the side walls are at substantially the same height over the entire length in forward and backward directions. A welding portion is formed at a front part of the terminal main body and a crimping portion is formed at a rear part of the terminal main body. Crimping pieces project from the upper ends of the side walls at the crimping portion.

Cores of wires are welded (thermocompression bonded) to the bottom wall at the welding portion and then the crimping pieces are crimped into connection with the insulation coatings of the wires in the crimping portion. However, the crimping portion and the welding portion are connected integrally to each other via the side walls. Thus, the welding portion may be deformed together with the crimping pieces as the crimping pieces are deformed. Connection reliability between the welding portion and the cores may be reduced if the welding portion is deformed.

The invention was completed based on the above situation and an object thereof is to ensure connection reliability in a welding portion.

SUMMARY OF THE INVENTION

The invention relates to a terminal fitting formed by bending a metal plate to define a terminal main body The terminal main body has a bottom wall that extends in forward and backward directions and on which wires are to be placed. Side walls stand up from opposite lateral sides of the bottom wall and extend in forward and backward directions. A welding portion is formed at a front part of the terminal main body and a crimping portion is formed at a rear part of the terminal main body. Cores of wires are welded to the bottom wall at the welding portion. Crimping pieces project from upper ends of rear parts of the side walls at the crimping portion and are offset from each other in forward and backward directions. The crimping pieces are crimped into connection with insulation coatings of the wires. Cutouts are formed at upper ends of the side wall of the crimping portion forward and rearward of the front crimping piece and the side wall corresponding to the cutouts still remains. The cutouts prevent deforming forces generated during crimping from being transmitted to the welding portion, thereby ensuring connection reliability in the welding portion. Further, the side wall corresponding to the cutouts remains even though the upper end of the side wall is cut out by the cutouts. Therefore, the wires contact the side wall from an inner side and will not come apart during welding.

The cutout may be at the front end of the rear crimping piece and the rear end of the rear crimping piece may be at the rear end of the entire terminal fitting. Thus, deformation of the crimping pieces is even less likely to affect the welding portion.

The cutout formed at the rear of the front crimping piece may be at a position facing the tip of the rear crimping piece when crimping the crimping pieces. Thus, the rear crimping piece can project a long distance toward the cutout.

The cutout at the rear end of the front crimping piece may be arranged substantially along forward and backward directions. Thus, the side wall corresponding to this cutout is strong and reliably prevents the wires from coming apart during welding.

A mounting portion may be formed before the terminal main body and may be a flat plate with an insertion hole for receiving a fixing device to mount the terminal fitting on a mounting object. A holding piece may project at the front end of the mounting portion and can be hooked on the mounting object. The holding piece has a substantially L-shape with a first piece bent at and extending from the front end of the mounting portion and a second piece bent at and extending from the extending end of the first piece. An extension length of the second piece is larger than a diameter of the insertion hole. Thus, even if the holding piece of a first terminal fitting is inserted into the insertion hole of a second terminal fitting, the holding piece of the second terminal fitting cannot be inserted into the insertion hole of the first terminal fitting. Thus, entangled terminal fittings can be separated easily.

Arcuate curved surfaces are formed on the inner surfaces of bent portions between the mounting portion and the first piece and between the first piece and the second piece.

If the inner surface of a bent portion is angular, stress may concentrate on the curved portion and a crack may be formed due to vibration or the like produced at the time of welding. However, the arcuate curved surfaces are formed on the inner surfaces of the bent portions. Therefore, stress will not concentrate on the bent portions is avoided and the bent portions will not be damaged or deformed.

DETAILED DESCRIPTION OF THE PREFERRED EMBODIMENTS

Figure 1:
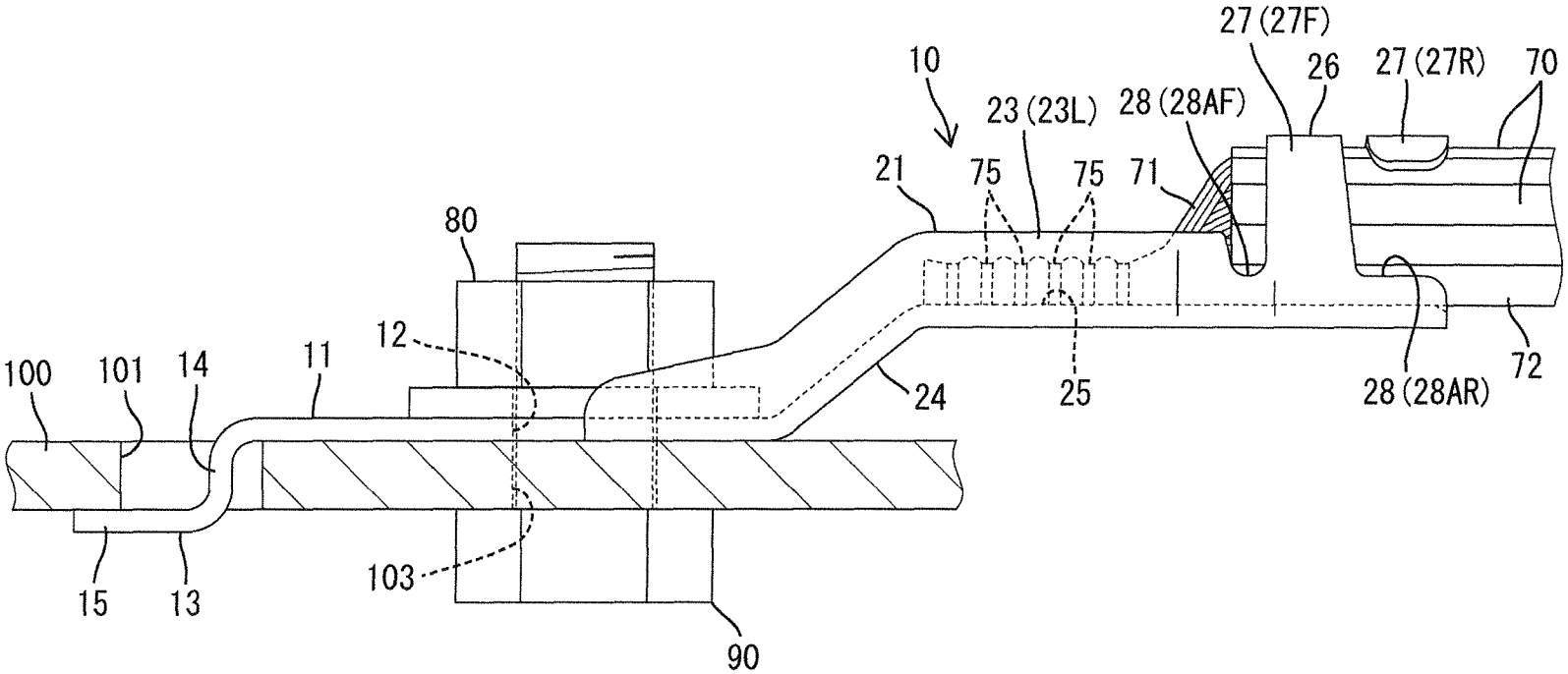
FIG. 1 is a side view showing a mounting structure of a terminal fitting according to one embodiment of the present invention.

A terminal fitting 10 according to the invention is illustrated in FIGS. 1 to 7 as a ground terminal that is fixed by a bolt 90 to a vehicle panel 100 in the form of a flat plate as a mounting object. In the following description, a leftward direction in FIG. 1 is referred to as a forward direction concerning forward and backward directions and a vertical direction is based on FIG. 1.

Figure 6:
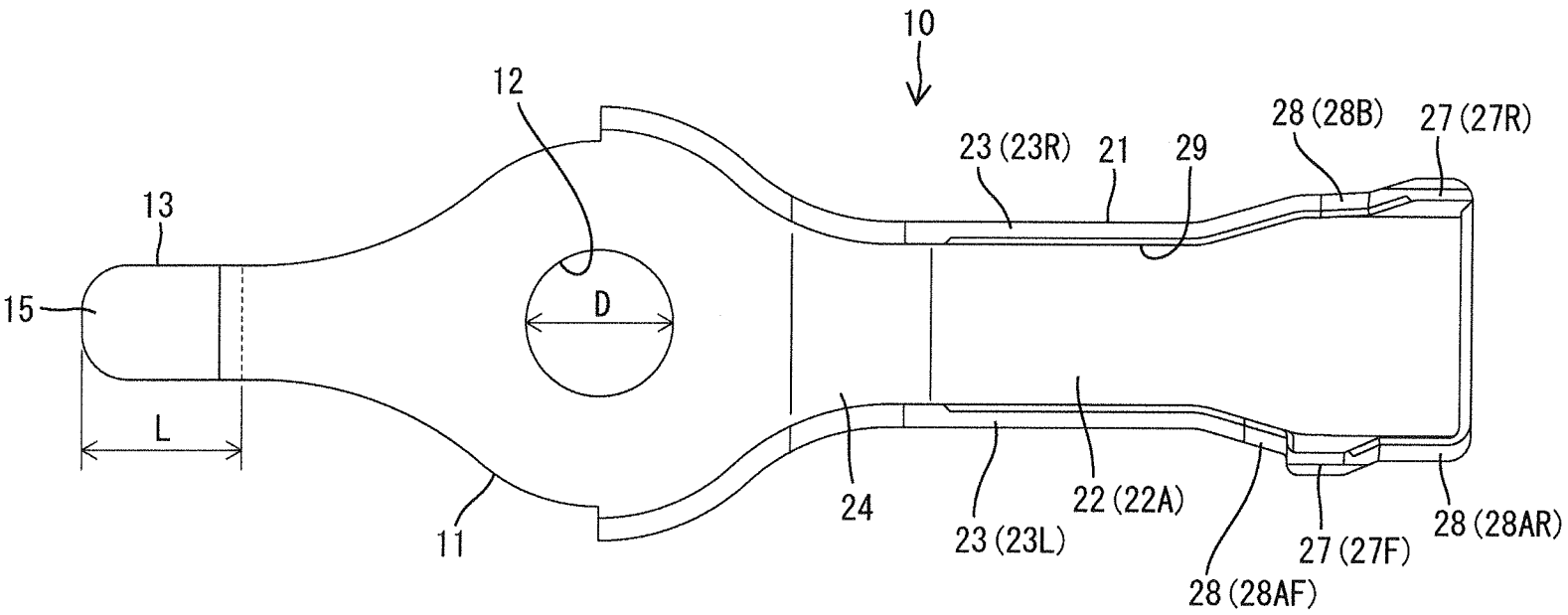
FIG. 6 is a plan view of the terminal fitting.
Figure 7:
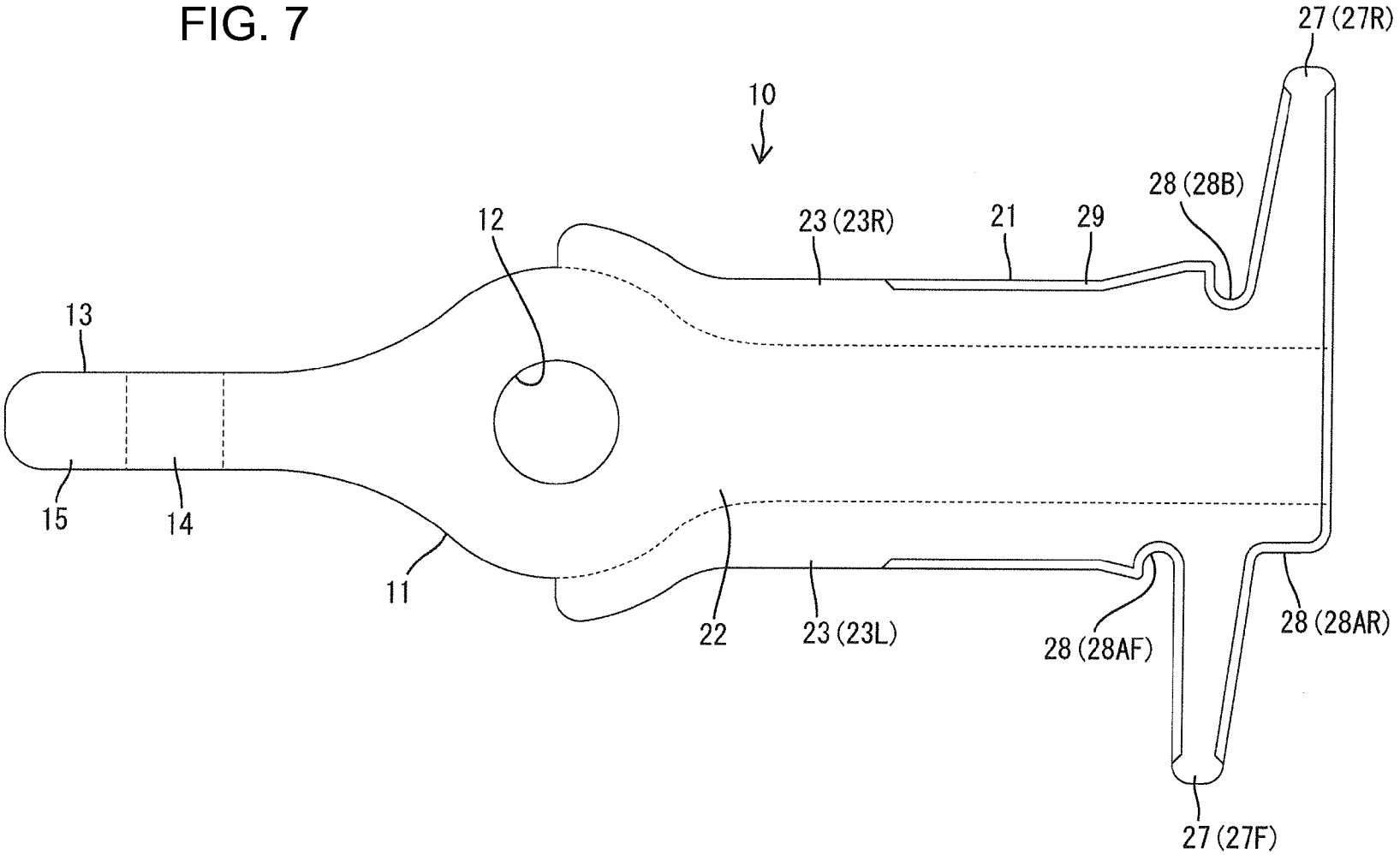
FIG. 7 is a development view of the terminal fitting.

The terminal fitting 10 is formed by bending a unitary metal plate having the shape shown in FIG. 7. The plate is long in forward and backward directions, as shown in FIG. 6.

A flat substantially circular mounting portion 11 is formed at a front part of the terminal fitting 10. A substantially circular insertion hole 12 is formed in a central part of the mounting portion 11 for receiving the bolt 90, as shown in FIG. 1.

Figure 4:
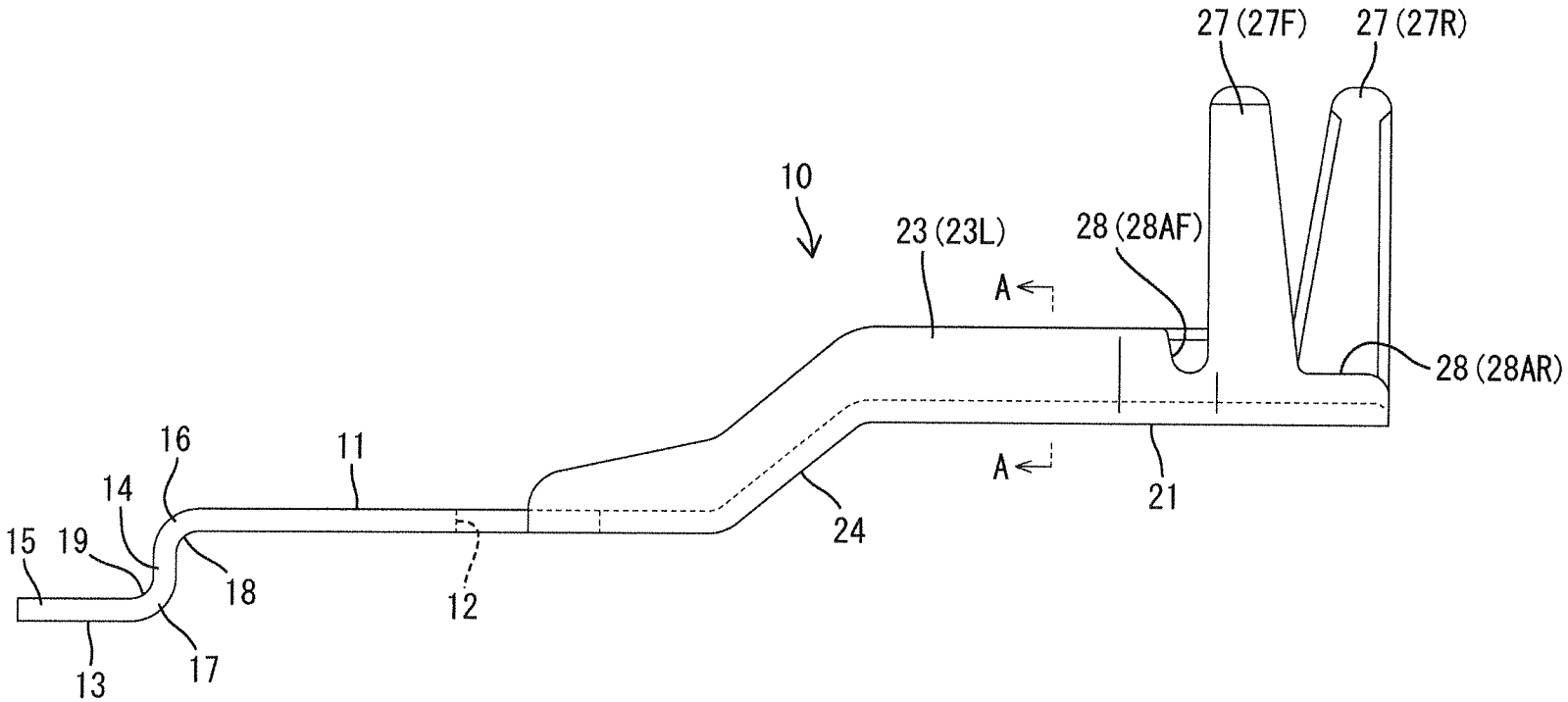
FIG. 4 is a side view of the terminal fitting.

A holding piece 13 projects at a substantially widthwise central part of the front end of the mounting portion 11. As shown in FIG. 4, the holding piece 13 is bent in a substantially L shape and includes a first piece 14 hanging down from the front end of the mounting portion 11 and a second piece 15 projecting forward from the lower end of the first piece 14. A first substantially right angle bend 16 is formed between the mounting portion 11 and the first piece 14, and a second substantially right angle bend 17 is formed between the first piece 14 and the second piece 15. Arcuately curved surfaces 18, 19 are formed on the concave faces of the first and second bends 16, 17, and no notch is formed in these curved surfaces. The holding piece 13 has substantially the same thickness over the entire length including positions where the first and second bends 16, 17 are formed.

The holding piece 13 is inserted into a holding hole 101 in the vehicle panel 100, as shown in FIG. 1. Thus, the mounting portion 11 is arranged along the front of the vehicle panel 100, the first piece 14 penetrates from the front to the rear of the vehicle panel 100 and the second piece 15 is arranged along the rear of the vehicle panel 100. Accordingly, the holding piece 13 hooks the vehicle panel 100 and holds the terminal fitting 10 temporarily. A circular through hole 103 penetrates through the vehicle panel 100 and can receive the bolt 90, as shown in FIG. 1. The bolt 90 is inserted through the through hole 103 and the insertion hole 12 and is screwed into a nut 80 on the front of the vehicle panel 100 to fix the terminal fitting 10 to the vehicle panel 100. The holding piece 13 is hooked with the edge of the holding hole 101 while screwing the bolt 90 into the nut 80 to prevent the terminal fitting 10 from rotating.

Figure 8:
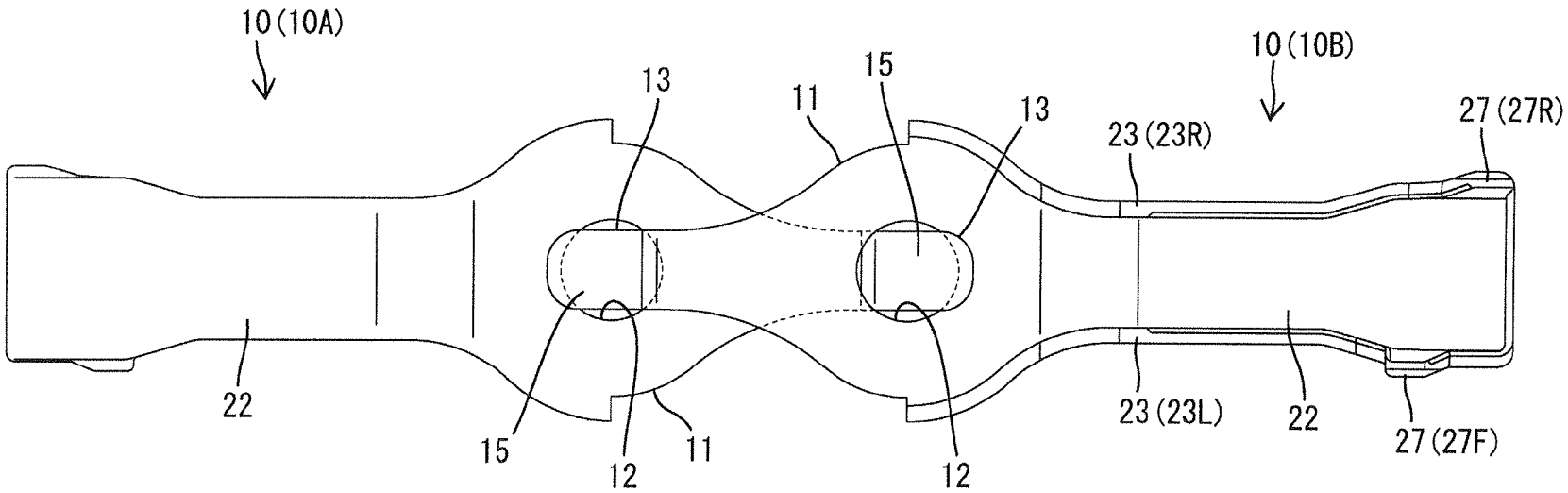
FIG. 8 is a plan view showing a state where a holding piece of one terminal fitting out of two terminal fittings is inserted into an insertion hole of the other terminal fitting, but the insertion of the holding piece of the other terminal fitting into an insertion hole of the one terminal fitting is prevented.
Figure 9:
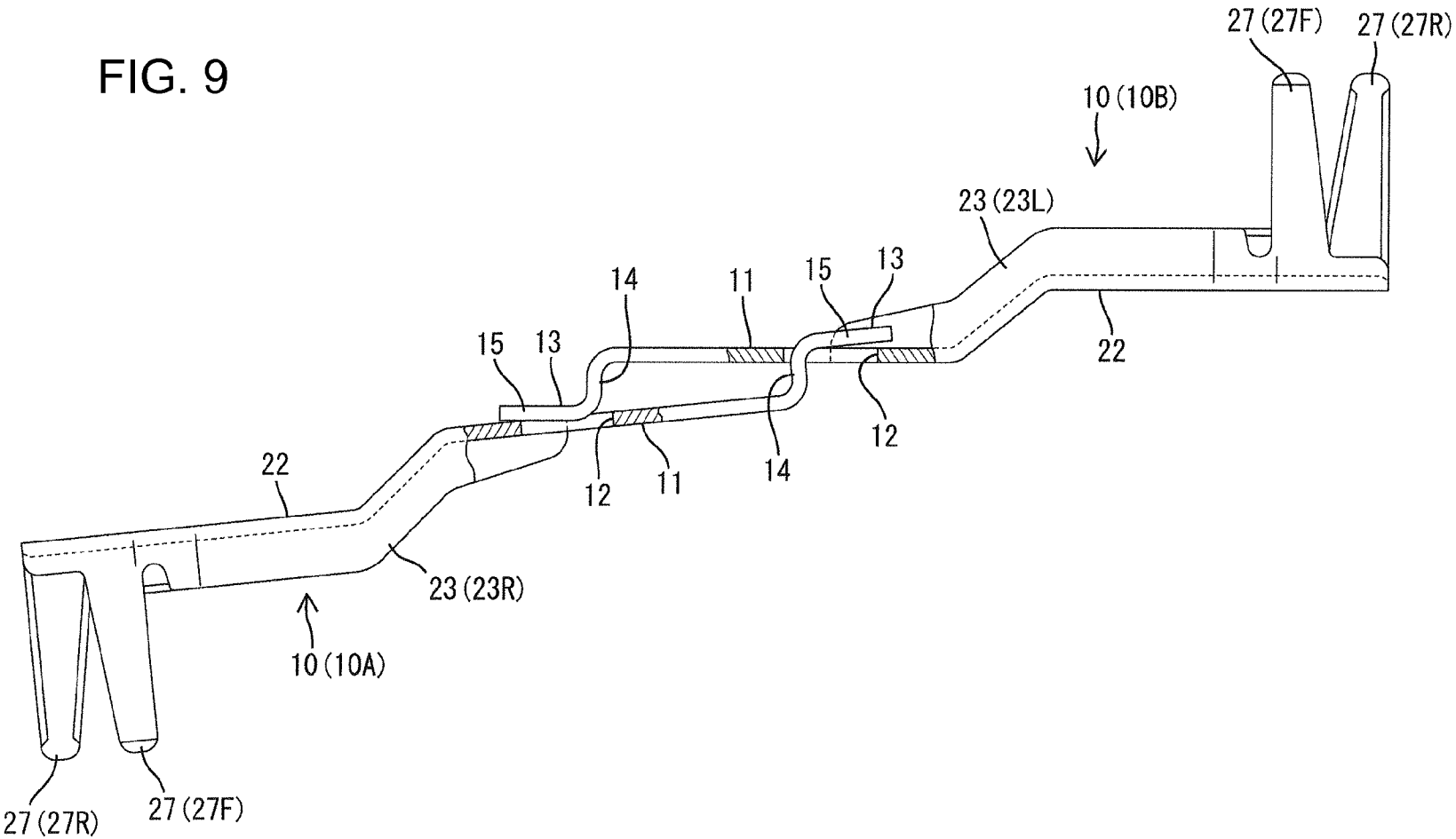
FIG. 9 is a side view partly in section showing the state of FIG. 8.

An extension length L of the second piece 15 in forward and backward directions is larger than a diameter D of the insertion hole 12, as shown in FIG. 6. With these dimensions, the holding piece 13 of a first terminal fitting 10A could be inserted unintentionally into the insertion hole 12 of a second terminal fitting 10B with the rear sides of the terminal fittings 10A, 10B facing each other, for example during storage or transit. Thus, the second piece 15 of the first terminal fitting 10A will emerge on the front side of the second terminal fitting 10B, as shown in FIGS. 8 and 9. However, the holding piece 13 of the other terminal fitting 10B cannot be inserted into the insertion hole 12 of the first terminal fitting 10A. As a result, the second piece 15 of the second terminal fitting 10B will remain in contact with the front side of the second terminal fitting 10A near the insertion hole 12 on the front side of the mounting portion 11. Thus the terminal fittings 10A, 10B will not be locked together.

Figure 2:
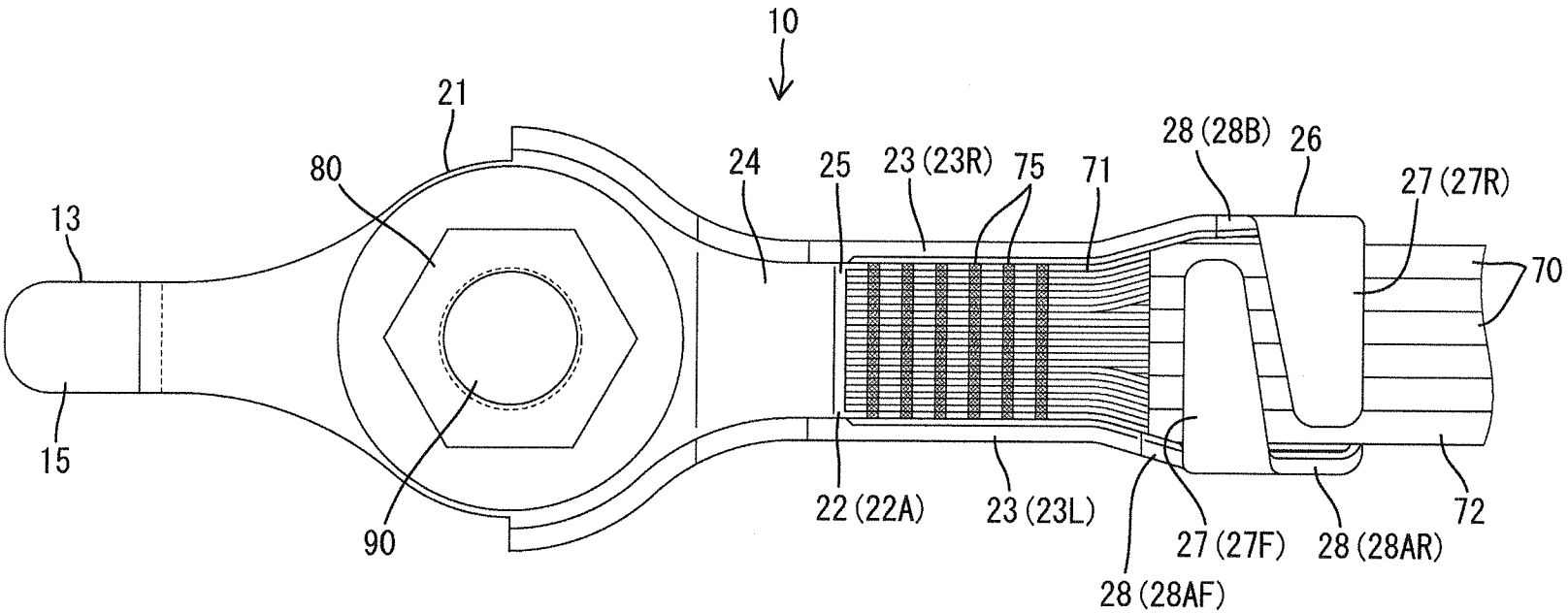
FIG. 2 is a plan view showing the mounting structure of the terminal fitting.
Figure 5:
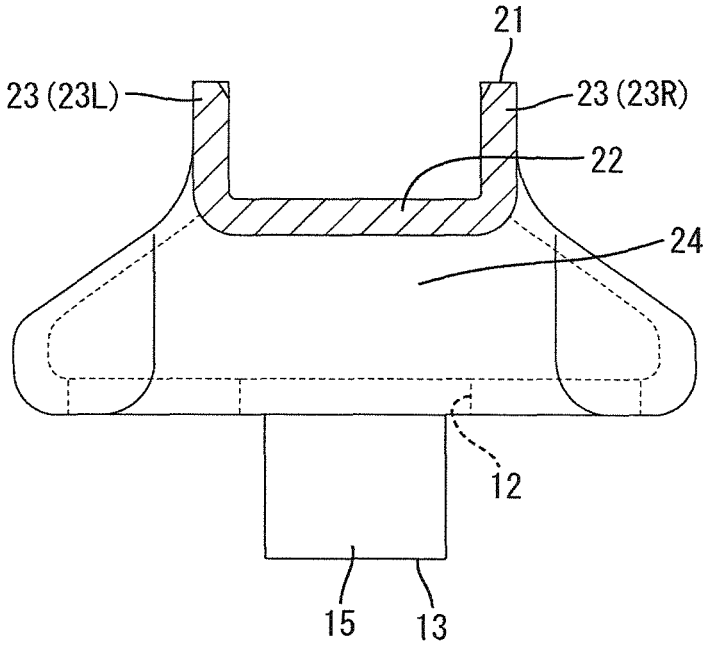
FIG. 5 is a section along A-A of FIG. 4.

A terminal main body 21 projects back from a substantially widthwise central part of a rear end of the mounting portion 11 of the terminal fitting 10, as shown in FIGS. 4 and 6. Specifically, the terminal main body 21 has a bottom wall 22 extending in forward and backward directions and side walls 23 standing up from the opposite lateral sides of the bottom wall 22 to define a substantially angular U-shaped cross section, as shown in FIG. 5. Wires 70 are placed on the bottom wall 22 along an extending direction of the wires 70, as shown in FIG. 2. A step 24 is formed at an intermediate position of the bottom wall 22 in its extending direction so that a part of the bottom wall 22 before the step 24 (closer to the mounting portion 11) is lower than a part behind the step 24, as shown in FIG. 4. The step 24 inclines down to the front from its upper end to the lower end.

The side walls 23 extend over the entire lengths of the opposite lateral sides of the bottom wall 22 and over substantially the half circumference of a periphery of the mounting portion 11, as shown in FIG. 6. The side walls 23 are bent to follow along the step 24, as shown in FIG. 4.

Figure 3:
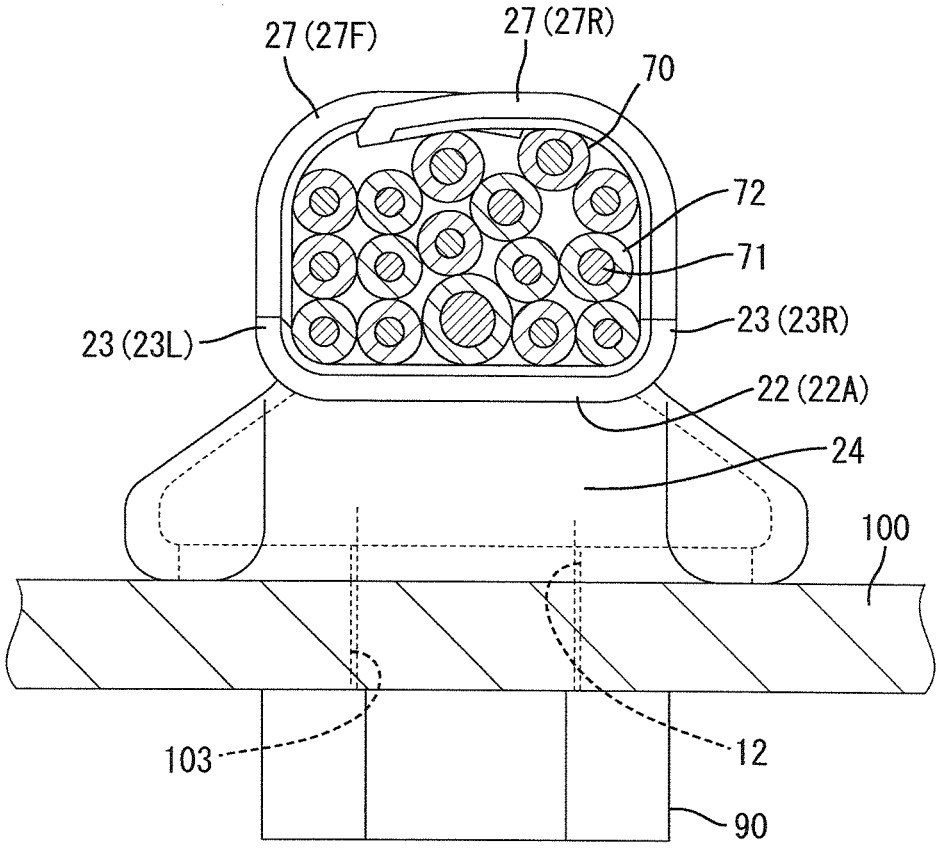
FIG. 3 is a rear view showing the mounting structure of the terminal fitting.

Each wire 70 has a core 71 and an insulation coating 72 surrounding the core 71, as shown in FIG. 3. The insulation coating 72 is removed at an end portion of the wire 70 to expose the core 71. A plurality of wires 70 are accommodated in a space defined by the bottom wall 22 and the side walls 23. Thus, the side walls 23 prevent loose outward movements of the respective wires 70 in a width direction. The wires 70 are arranged on an elevated portion 22A of the bottom wall 22 behind the step 24 and leading ends of the cores 71 are at substantially the same position as the upper end of the step 24 in forward and backward directions, as shown in FIGS. 1 and 2.

A welding portion 25 is formed at a front part of the elevated portion 22A of the terminal main body 21, as shown in FIG. 1, and the cores 71 of the wires 70 are welded in the welding portion 25. The cores 71 include melted portions 75 melted by ultrasonic welding, as shown in FIG. 2, and are welded and fixed integrally to the base wall 22 via the melted portions 75.

A crimping portion 26 is formed at a rear part of the elevated portion 22A of the terminal main body 21. The crimping portion 26 has crimping pieces 27 projecting from the upper ends of the respective side walls 23 to form an open barrel. The crimping pieces 27 are offset in forward and backward directions. As shown in FIGS. 1 to 3, the insulation coatings of the wires 70 are placed on the base wall 22 of the crimping portion 26 and, in this state, the crimping pieces 27 are crimped into connection with the insulation coatings 72 from the outer sides while wrapping around them. The crimped crimping pieces 27 pass one another in a circumferential direction.

Cutouts 28 are formed in the upper ends of the side walls 23, as shown in FIGS. 1 and 6. The cutouts 28 include two first cutouts 28AF, 28AR respectively at front and rear sides of the front crimping piece 27F at the upper end of the left side wall 23L in FIG. 6 and a second cutout 28B at the front side of the rear crimping piece 27R at the upper end of the other side wall 23R in FIG. 6. As shown in FIG. 4, the rear end of the rear crimping piece 27R extends continuously up from the rear end of the right side wall 23R without a step and is at the rear end of the entire terminal fitting 10. The side walls 23 still exist where the cutouts 28, but are at lower positions.

As shown in FIG. 4, the front first cutout 28AR has a substantially U-shape while being connected to the front end of the front crimping piece 27F. However, the rear first cutout 28AR is cut straight in forward and backward directions while being connected to the rear end of the front crimping piece 27F. The rear end of the rear first cutout 28AR is at the rear end of the entire terminal fitting 10. The rear first cutout 28AR is substantially at the same position as the rear crimping piece 27R in forward and backward directions and, as shown in FIG. 1, and faces the tip of the rear crimping piece 27R in the crimped state. As shown in FIG. 7, the second cutout 28B has a substantially U-shape while being connected to the front end of the rear crimping piece 27R. Note that the inner surfaces of the upper ends of the both side walls 23 are cut to form chamfered portions 29 from the welding portion 25 to the crimping pieces 27.

The terminal fitting 10 is assembled by first welding the cores 71 of the wires 70 to the bottom wall 22 of the welding portion 25. In this way, the wires 70 are connected electrically conductively to the terminal fitting 10. The wires 70 contact inner sides of the side walls 23 at the time of welding to avoid coming apart outward in the width direction.

Subsequently, the crimping pieces 27 are crimped into connection with the insulation coatings 72 of the wires 70 to retain the wires 70 in the terminal fitting 10 as shown in FIG. 3. The crimping pieces 27 are bent and deformed in the crimping process and, accordingly, the side walls 23 connected to the crimping pieces 27 also are bent and deformed. However, the forces that deform the crimping pieces 27 are substantially cut off at the front first cutout 28AF and the second cutout 28B. Thus, the crimping forces are not transmitted to the welding portion 25.

Thereafter, the holding piece 13 of the terminal fitting 10 is hooked on the vehicle panel 100, as shown in FIG. 1. The bolt 90 then is inserted into the insertion hole 12 of the terminal fitting 10 and screwed into the nut 80 to mount and fix the terminal fitting 10 to the vehicle panel 100.

As described above, the crimping portion 26 has the first cutouts 28AF, 28AR cut into the upper end of the first side wall 23L at front and rear sides of the front crimping piece 27F. Thus, even though the crimping pieces 27 are deformed during crimping, the first cutouts 28AF, 28AR prevent a transmission of deforming forces to the welding portion 25. Therefore, connection reliability in the welding portion 25 is ensured.

Further, parts of the side walls 23 remain below the cutouts 28 and have a specified strength. Thus, the wires 70 cannot come apart during welding.

The second cutout 28B is formed in the crimping portion 26 at the front side of the rear crimping piece 27R for further preventing the deformation of the crimping pieces 27 from affecting the welding portion 25. In addition, the rear end of the rear crimping piece 27R is at the rear end of the entire terminal fitting 21. Thus, the strength of the side wall 23 can be maintained high.

Further, the first cutout 28AR at the rear side of the front crimping piece 27F in the crimping portion 26 faces the tip of the rear crimping piece 27R after crimping. Thus, the rear crimping piece 27R can project a long distance toward this first cutout 28AR.

The rear first cutout 28AR extends substantially along forward and backward directions. Thus, a high strength is ensured for the first side wall 23L near the first cutout 28AR and the wires 70 reliably are prevented from coming apart during welding.

The extension length L of the second cutout 15 is larger than the diameter D of the insertion hole 12. Thus, even if the holding piece 13 of a first terminal fitting 10A is inserted into the insertion hole 12 of a second terminal fitting 10B, the holding piece 13 of the second terminal fitting 10B cannot be inserted into the insertion hole 12 of the first terminal fitting 10A. Thus, the two terminal fittings 10 will not become entangled with each other and can be separated easily from each other.

The arcuate curved surfaces 18, 19 are respectively formed on the concave surface of the first bend 16 between the mounting portion 11 and the first piece 14 and on the concave surface of the second bend 17 between the first piece 14 and the second piece 15. Therefore, there is no stress concentration on the first and second bends 16, 17 and damage and deformation of the first and second bends 16, 17 are prevented.

The invention is not limited to the above described embodiment. For example, the following embodiments also are included in the scope of the invention.

Hot welding may be performed for the welding portion.

The rear crimping piece is distant from the welding portion and a force to deform the rear crimping piece is unlikely to reach the welding portion. Thus, the second cutout may be omitted from the other side wall.

A cutout may be formed also at the rear end of the rear crimping piece by cutting the upper end of the other side wall.

The invention is applicable to terminal fittings other than ground terminals.

What is claimed is:

1. A terminal fitting having opposite front and rear ends and comprising:

a mounting portion at the front end and configured for connection to an object;

a terminal main body extending rearward from the mounting portion, the terminal main body having a bottom wall extending in forward and rearward directions and a step formed at an intermediate portion of the bottom wall in an extending direction to define an elevated portion rearward of the step, a welding portion formed on the elevated portion and configured to have wires welded thereon, side walls projecting from opposite lateral sides of the bottom wall and having substantially uniform heights along an entire length of the welding portion; and a crimping portion rearward of the welding portion, the bottom wall and the side walls extending continuously into the crimping portion, front and rear crimping pieces projecting from upper ends of the side walls at the crimping portion, a distance from the front crimping piece to the welding portion being less than a distance from the rear crimping piece to the welding portion, cutouts being cut into the upper end of the side wall at least at front and rear sides of the front crimping piece so that parts of the side wall at the cutouts are lower than parts of the side walls at the welding portion, whereby the cutout forward of the front crimping piece prevents transmission of crimping forces to the welding portion.

2. The terminal fitting of claim 1, wherein the cutout at the rear side of the front crimping piece in the crimping portion faces a tip of the rear crimping piece after crimping the crimping pieces.

3. The terminal fitting of claim 2, wherein the cutout at the rear side of the front crimping piece has an edge aligned substantially along forward and backward directions.

4. The terminal fitting of claim 1, wherein:

the mounting portion includes an insertion hole through which a fixing device used to mount the terminal fitting on a mounting object is inserted;

a substantially L-shaped holding piece projecting at a front end of the mounting portion that can be hooked on the mounting object and comprising a first piece bent at and extending from the front end of the mounting portion and a second piece bent at and extending from an extending end of the first piece ; and an extension length of the second piece is larger than a diameter of the insertion hole.

5. The terminal fitting of claim 4, wherein arcuate curved surfaces are formed on the concave surfaces of bends between the mounting portion and the first piece and between the first piece and the second piece.

6. The terminal fitting of claim 1, wherein the cutouts include a cutout formed at a front side of the rear crimping piece and a rear end of the rear crimping piece is at the rear end of the terminal fitting.

7. The terminal fitting of claim 1, wherein the side walls extend from the step onto the mounting portion.

8. The terminal fitting of claim 1, wherein the step is aligned oblique to the mounting portion and the welding portion.

* * * * *